United States Patent [19]

Jones

[11] 4,015,985

[45] Apr. 5, 1977

[54] COMPOSITE XEROGRAPHIC PHOTORECEPTOR WITH INJECTING CONTACT LAYER

[75] Inventor: Robert N. Jones, Fairport, N.Y.

[73] Assignee: Xerox Corporation, Stamford, Conn.

[22] Filed: Apr. 9, 1975

[21] Appl. No.: 566,456

[52] U.S. Cl. ..... 96/1.5; 96/1.8; 252/501

[51] Int. Cl.[2] ..... G03G 5/08

[58] Field of Search ..... 96/1.5, 1.8; 252/501

[56] References Cited

UNITED STATES PATENTS

| | | | |
|---|---|---|---|
| 2,554,017 | 5/1951 | Dalton | 96/1.8 X |
| 3,113,022 | 12/1963 | Cassiers et al. | 96/1.5 |
| 3,468,660 | 9/1969 | Davenport et al. | 96/1.5 |
| 3,615,400 | 10/1971 | Augostini et al. | 96/1.5 |
| 3,639,121 | 2/1972 | York | 96/1.5 |
| 3,649,354 | 3/1972 | TeVelde | 96/1.5 X |
| 3,787,208 | 1/1974 | Jones | 96/1.5 X |
| 3,899,327 | 8/1975 | Esser et al. | 96/1.5 |

FOREIGN PATENTS OR APPLICATIONS

| | | | |
|---|---|---|---|
| 912,837 | 12/1962 | United Kingdom | 96/1.8 |
| 960,871 | 6/1964 | United Kingdom | 96/1.8 |

*Primary Examiner*—Roland E. Martin, Jr
*Attorney, Agent, or Firm*—James J. Ralabate; James P. O'Sullivan; Ronald L. Lyons

[57] ABSTRACT

A photoreceptor used in xerographic imaging process and normally including a photoconductive layer comprising a mixture of photoconductive particles dispersed throughout the layer with resinous binder material is joined by bonding to a conductive base layer through an intermediate layer which provides a charge carrier injecting interface between the photoconductive particles and the base layer. The charge carrier interface is obtained by forming the intermediate layer from high mass conductive particles dispersed within an insulating resinous material, and causing photoconductive particles in the photoconductor layer to contact conductive particles in the intermediate layer along the bond interface. The conductive particles are selected so as to have available charge carriers at suitable energy levels whereby the photoconductor to conductor particle contact points form individual charge carrier injection contacts which permit certain xerographic imaging processes to be used. The mass and volume loading of conductor particles in the intermediate layer causes such layer to be conductive as a whole whereby the photoconductive layer may be connected to ground or any other potential desired at its backside. The invention has particular utility in combination with a controlled geometry photoconductive layer, and a simple method using heat for obtaining the injecting contact while making the controlled geometry photoconductive layer is described.

5 Claims, 2 Drawing Figures

Fig. 1.
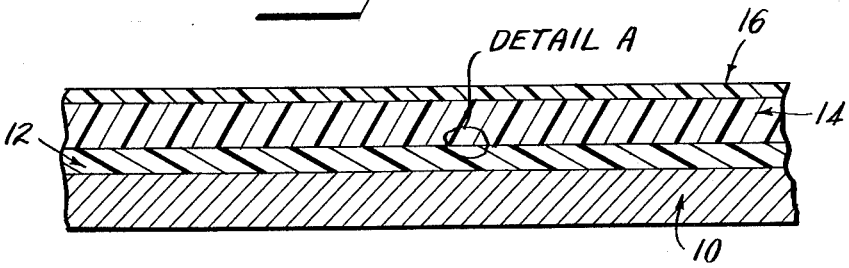
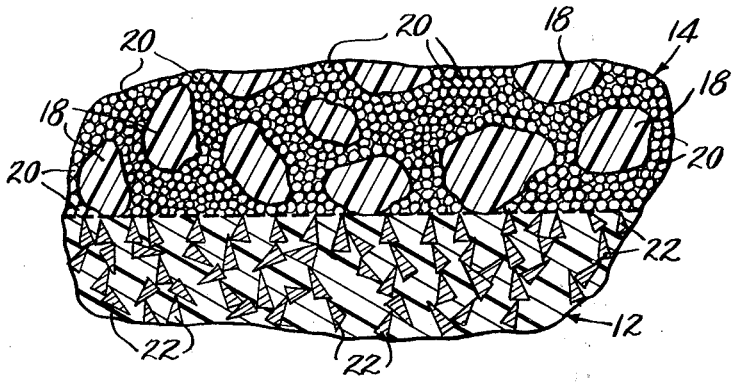
Fig. 2.

COMPOSITE XEROGRAPHIC PHOTORECEPTOR WITH INJECTING CONTACT LAYER

BACKGROUND OF THE INVENTION

This invention relates to xerography, and more specifically to an improved photoreceptor device for use in a xerographic process. The improvement constituting the subject matter of this application is a means for obtaining an injecting contact at the interface of the photoconductor layer and the base of the photoreceptor, the photoconductor layer comprising minute photoconductor particles supported by and dispersed within an insulative resin matrix.

The present invention has particular application in connection with a photoreceptor device having a photoconductive phase such as is described in Jones U.S. Pat. No. 3,787,208, with or without a dielectric overcoating, depending upon the ultimate xerographic process in which the photoreceptor is to be applied. This type of photoconductive material will hereinafter be referred to as "controlled geometry" photoconductor material.

Controlled geometry photoconductor material is fully described in the above Jones patent, to which reference may be made for a complete understanding of a photoreceptor using this material and the various processes by which it may be obtained. For purposes of the present application, suffice it to say that the controlled geometry photoconductive material comprises a photoconductive insulating layer comprising an insulating organic resin matrix and a photoconductive material, with substantially all of the photoconductive material lying in a multiplicity of interlocking photoconductive continuous paths through the thickness of the layer. The photoconductive material constitutes from about 1 to 25% of the photoreceptor layer, and the interlocking path arrangement of the photoconductive material is achieved by controlling the bulk geometry of the layer. In brief, relatively larger resin particles are merged with significantly smaller photoconductive particles so that the latter occupy the interstitial space of the packed resin particles. This general relationship of the particles remains during and after the resin curing operation wherein a carrier liquid (not a solvent for either the resin or photoconductor particles) is removed from the assembly and the resin particles are bonded together at their areas of contact. The size of photoconductor particles in the controlled geometry system may vary, but as disclosed in the Jones patent, is preferably in the order of 5 times smaller than the resin particles, or smaller, usually in the range of 0.01 to 1 micron, preferably about 0.5 microns, depending on the desired order of resolution required and the ultimate xerographic process in which the photoreceptor layer is intended for use.

The present invention also has particular utility in an electrophotograhic imaging process using the controlled geometry photoconductor layer with a translucent or transparent dielectric overcoating wherein the dielectric layer is first surface charged to a high potential of opposite polarity to the photoconductor mobile charge carriers; the overcoated photoconductor is exposed to a light and dark image pattern while the surface of the dielectric layer is charged with a reverse polarity field or an AC field to produce at uniform surface potential a charge density pattern corresponding to the light and dark image pattern; and finally uniformly illuminating the overcoated photoreceptor to increase the charge potential in the dark areas of the image pattern and thereby improve the contrast ratio in the final developed image. The thus charged photoreceptor is capable of remaining charged with the image pattern when illuminated as well as in the dark and can be developed using any conventional xerographic process. This imaging process is more completely described in U.S. Pat. Nos. 3,794,539 and 3,775,104, for example, and does not constitute per se the subject matter of the present invention. In this process it is essential that the first charging create a potential only across the dielectric layer and not across the combination of dielectric layer and photoconductive layer. Therefore, since the charge carriers on the photoconductive layer must freely be energized from the backside of the photoconductor layer to enable the migration of charges from the base of the photoreceptor to the interface between photoconductive and dielectric layers, a charge injecting contact between the base and photoconductive material is absolutely essential to enable the initial charging of the dielectric layer to occur in cyclic fashion.

It has been learned, however, that in circumstances where an insulative matrix is used to carry the photoconductive material, and where the latter is provided as particles of extremely small size, the necessary injecting contact between the photoconductor material and base is prevented by a layer of resinous matrix between most, if not all, of the photoconductor particles and the conductive base. The exact mechanism by which the photoconductor particle to base contact is lost is not fully understood, but is believed to be caused by the inability of the small photoconductive particles to overcome the surface tension of the resinous material in which the small particles are carried. This has particularly been observed where the photoconductor layer is formed by a controlled geometry method.

The present applicant has discovered that an injecting contact between the photoconductor and the base layer can be provided to overcome the problem, while at the same time achieving a suitable bond between the two layers. In short, both a means for achieving this injecting contact and the method of its fabrication constitute the subject matter of this invention, in an environment such as has been set forth above.

The present invention therefore has as its primary objective the provision of an injecting contact between a photoconductor layer and conductive base layer in a unique manner that enables the contacts to be made while a controlled geometry photoconductor layer is being made.

SUMMARY OF THE INVENTION

This invention resides in a particular form of injection contact layer and the method of its fabrication in a xerographic photoreceptor system using a controlled geometry photoconductor layer of the type described in U.S. Pat. No. 3,787,208 to Jones. Both the present applicant and assignee of this application are the same as those named in U.S. Pat. No. 3,787,208. The invention is considered to have particular utility in connection with an imaging process of the type described in U.S. Pat. No. 3,794,539 with reference to abandoned applications Ser. No. 563,899 filed July 8, 1966 and Ser. No. 571,538 filed Aug. 10, 1966, both of the latter being cited as a matter of public record in U.S. Pat. No. 3,794,539, as well as other U.S. Pats. assigned to Canon Kabushiki Haisha of Tokyo, Japan. This imaging process is also disclosed in U.S. Pat. No. 3,775,104 and others assigned to the above company. The imaging process per se forms no part of the present invention other than to form an environment where the injecting contact layer may be utilized to overcome the effects of a blocking contact between the photoconductor layer and a base conductive layer during multiple recycling operations of the imaging process.

In general, the present invention contemplates using an intermediate layer between a controlled geometry photoconductive and conductive base layer in a xerographic photoreceptor system, the intermediate layer including a high volume of conductive particles in a resinous matrix and being joined to the photoconductor layer along a bonded interface where photoconductor and conductor particles contact each other in a charge carrier injecting relationship. The bond interface is achieved by overlaying the photoconductor layer on the intermediate layer and heating the two layers so that the resins soften and mix slightly at the bond interface. This causes the photoconductive particles and conductive particles to migrate slightly and physically contact each other along the interface. If the conductor particles in the intermediate layer are chosen properly so that they contain sufficient available charge carriers at sufficient energy levels to form an injecting contact with the photoconductor particles, the intermediate layer as a whole forms a charge injecting contact layer as a whole for the photoconductive layer and, if the conductive particles in the intermediate layer electrically contact the base material, the intermediate layer becomes itself grounded like the base layer. Theoretically at least, the intermediate layer can act itself as a charge carrier sink for the photoconductor layer if sufficient conductive particles are provided in the intermediate layer so long as the injecting relationship between photoconductive and conductive particles exists. The intermediate layer preferably is bonded to the base layer, of course, through the resin matrix of the intermediate layer. The essential characteristic of the intermediate injecting layer is that when the junction is formed between it and the photoconductor layer, a particle to particle conductive contact exists between photoconductor particles in the photoconductor layer and the conductive particles in the intermediate injection layer at the interface between the two layers, while the resin to resin interface between the layers constitutes a bonded, fused or similar joint connection between the layers.

It has been found that a photoreceptor having a controlled geometry photoconductor layer and an injecting contact intermediate layer of this type can be readily formed having the desired electrical and mechanical properties by first applying the intermediate layer to the base in fluid form; evaporating the solvent or liquid carrier to at least partially solidify the intermediate coating; next applying the controlled geometry photoconductor coating to the intermediate coating in fluid form and evaporating off the liquid carrier of this coating, and finally heating the composite to cause a mixing of the two resins in each layer along the interface of the layers and to cause the photoconductor particles and conductive particles in each layer to contact each other. Thus, upon final curing and cooling of the composite, a strong bond is obtained between the resinous phases, while a particle to particle contact exists between the photoconductive and conductor particles in each layer along the interface between the layers.

The conductive particle loading of the intermediate injecting contact layer is sufficient to theoretically enable the layer to function as a charge carrier sink as a whole for the composite assembly without the intermediate layer itself being conductively joined to the base conductor. Actually, in practice, due to the nature of the conductive particles, their size, the surface tension of the resinous phase in liquid or partially liquid form, a conductive as well as injecting contact between the intermediate layer and the conductive base layer is usually desired and obtained. Since the intermediate layer essentially must form an injecting contact between the photoconductor and intermediate layer, the present invention must be distinguished from photoreceptor systems using simply a conductive adhesive between a photoconductive layer and a conductive base layer. Such a system can be found described in U.S. Pat. No. 3,457,070 to Watanabe et al, Example I therein. In actuality, such conductive adhesive layers generally are utilized without regard as to whether or not an injection contact is made or is available at the photoconductive to adhesive interface, since obtaining an injection contact requires that materials having suitably compatible energy levels be utilized and that a certain physical relationship between the photoconductor and conductive particles be maintained at the interface between the photoconductor layer and the intermediate layer. If the materials used and relationship between particles is not designed to obtain an injecting contact between the photoconductive and adhesive layers, in fact a blocking contact may be obtained between the layers even though the adhesive is referred to as being "electrically conductive."

The present invention therefore is not to be characterized as an electrically conductive bond between photoconductor and base in a multi-layer photoreceptor system, but rather as an injecting contact layer between these elements of the system which also functions as an effective adhesive joint between the photoconductor and base layers.

BRIEF DESCRIPTION OF THE DRAWINGS

In general, the advantages of the improved structure and method contemplated by the instant invention will become apparent upon consideration of the following disclosure of a preferred embodiment of the invention, especially when considered in conjunction with the attached drawings wherein:

FIG. 1 schematically shows a cross-sectional elevation view of a composite photoreceptor system including the injection contact layer formed in accordance with this invention; and FIG. 2 shows an enlarged detail view of area A in FIG. 1 at the interface between photoconductive layer and injecting contact layer of the photoreceptor system shown in FIG. 1.

DETAILED DESCRIPTION OF PREFERRED EMBODIMENTS OF THE INVENTION

With reference to the drawings, a four-layered composite photoreceptor system constructed in accordance with the instant invention comprises a conductive base or substrate 10 having adhered thereto an intermediate injection contact layer formed in accordance with this invention, a controlled geometry photoconductive layer 14, and an optional dielectric coating 16. The base material 10 is conductive preferably and may be constructed in accordance with accepted practice in the xerographic arts so as to be compatible with the remaining materials in the photoreceptor system and to provide whatever structural characteristics are desired for the system. The base serves as a ground plane for the system, but at least theoretically it is believed that the intermediate injecting contact layer also itself may serve as a ground plane in the present system, that is, a source of mobile charges of either polarity, due to the presence of conductive particles in the intermediate layer.

An enlarged diagramatic view of section A in FIG. 1 is shown in FIG. 2. The physical makeup of the photoconductor layer 14 is there illustrated and conforms to the photoconductive material described in U.S. Pat. No. 3,787,208. The particles 18 constitute the resinous phase of the photoconductor layer 14 while the particles 20 constitute the photoconductive particles of layer 14.

Reference may be had to the U.S. Pat. No. 3,787,208 for the specific materials contemplated as being suitable for use in the layer 14, as well as the base layer 10 but it will be noted that the mean size of the photoconductor particles is contemplated as being in the order of 0.5 to 1 microns in size, with a distribution of from 0.01 to 8 microns, while the mean size of the resin binder particles is in the order of 5 microns, with a distribution of from about 1 to 12 microns. The photoconductor particles 20 are disposed in the binder particles 18, and both are dispersed in a typical liquid carrier, not illustrated. The dispersion is coated over the injection contact layer 12 which will be described in some detail below and the liquid carrier evaporated off, with or without low heat input which may assist the liquid evaporation process.

Due to the small size of the photoconductive particles (less than 5 microns in mean size, usually 0.01 to 1 micron), the normal procedure of simply applying the photoconductive layer to a conductive base by coating does not result in the formation of a junction across which charge carriers freely migrate in both directions upon repeated cycles of charging the photoconductor device. As explained previously above, it is believed that this is due to the presence of at least some resin material between the photoconductor particles and the base material, although the precise cause of the blocking nature of the contact may involve other factors also. It has been observed, however, that a blocking contact does exist, and this prevents proper initial charging of a dielectric overcoating by a field which is opposite in sign to the mobile charge carriers in the underlying photoconductive layer during a specific type of imaging process.

To overcome the problem, an intermediate layer 12 is provided which not only provides a bond between itself and the photoconductor and base layers 10 and 14, but also forms an injecting and conductive contact between these layers.

Intermediate layer 12 essentially comprises a coating of high mass conductive particles dispersed in a plastic resin. The conductive particles themselves are chosen so as to have available charge carriers compatible with the charge carriers of the particular photoconductive particles used in layer 14 so that, depending on the direction of applied potential, an injection contact rather than a blocking contact occurs between the conductive particles 22 and the photoconductive particles 20 wherever these particles physically contact each other.

To insure both that the conductive and photoconductive particles physically and electrically contact each other while at the same time an effective mechanical bond is obtained between layers 10, 12 and 14, the present invention contemplates applying intermediate layer 12 upon base layer 10 as a suitable resinous coating, the resinous coating containing an appropriate loading of conductive particles 22 which produce an injecting type of contact between photoconductive particles 20 and conductive particles 22 in the system where the two physically contact each other. The resinous phase of layer 12 may be derived in a manner similar to the resinous phase used in the photoconductive layer (larger resin particles in a liquid carrier such as ethylene glycol which is evaporated off) or may be a solution of resin (polyurethane) in a suitable solvent liquid medium which is evaporated off. In either situation, between 25 and 99% (preferably about 50%) by volume of the intermediate layer 12 is comprised of small conductive particles (0.1–5microns) such as silver, gold, platinum, etc. which are dispersed uniformly throughout he coating and which are charge carrier injecting materials with respect to the photoconductor particles used in the photoconductor layer 14 (e.g., cadmium sulfoselenide $CdS_{.6}Se_{.4}$). The layer 12 is relatively thin (5 microns) but with the thickness not being particularly critical with respect to the injecting contact function that the layer 12 is to perform. The conductive particles 22 therein are provided in sufficient volume to contact each other within the coating 12 as illustrated.

After the coating 12 has been formed, controlled geometry photoconductive layer 14 is deposited thereon in the manner described in U.S. Jones Pat. No. 3,787,208. Example XII in that patent describes how a suitable photoconductive layer is obtained as the layer 14 of this invention. There, a dispersion of cadmium sulfoselendide particles ranging in size from 0.001 to 0.4 microns in a copolymer of 70% isobutyl methacrylate and 30% styrene in powder form wherein the mean particle size ranges from 1 to 8 microns (mean size 5 microns) and a liquid carrier (silicone fluid) is deposited on a substrate and the carrier evaporated off. Subsequent heating of the layer leaves a continuous layer about 55 microns thick of fused resin with the photoconductor particles constituting less than 25% by volume of the photoconductive layer, but this final heating step is not performed yet in this invention. As illustrated in FIG. 2, the photoconductive particles 20 form continuous photoconductive paths through the photoconductive layer 14 between the resin phase 18. The ends of the photoconductive paths adjacent the intermediate layer 12 must now be connected electrically and in a charge carrier injecting sense to the conductive particles 22 in layer 12. (The dielectric overcoating 16 may be applied at anytime in a conventional manner.)

The present invention contemplates that the final heating step for coalescing the resin particles of the controlled geometry photoconductor layer 14 will include heating of the intermediate layer also simultaneously. The resulting softening and slight flow of resins that occurs between the conductive and photoconductive layers as a result of the heating causes the particles 20 and 22 to come into contact with each other along the interface between the layers. Upon cooling, the layers 12 and 14 as well as base layer 10 which also may be heated simultaneously, are all adhesively bonded to each other through the resins. Alternatively, of course, any resin binder material used to carry a photoconductive particle dispersion could be joined to the intermediate layer and the two layers bonded together using adequate heat to enable the photoconductive and conductive particles 20 and 22 to come into contact with each other along the bond interface. The ultimate advantage of the process outlined above is that the controlled geometry photoconductor layer 14 can be formed at the same time as the injecting contact is made by using appropriate materials and an appropriate heating cycle for the materials involved.

Of course, the procedure outlined above is not necessarily the only procedure available for obtaining the desired injection contact junction between layers 12 and 14. By suitably choosing time and temperature parameters, layer 12 could be a pre-formed film and layer 14 likewise could be a pre-formed film, with the injection contact junction formed by heating the two layers 12 and 14 while they are maintained in intimate contact with each other. The temperature would be chosen so that the resins would soften and microscopic flow between the layers would accomplish the bond and the physical abutment of photoconductive and conductive particles 20 and 22. Similarly, the films 12 and 14 could be preformed on a separate substrate, joined with heat to form an injecting contact interface between photoconductive and conductive particles as well as a mechanical bond between layers and finally transferred to the base layer 10 in accordance with any conventional technique. Quality control, of course, becomes more difficult when films are pre-formed and transferred as compared with coating the layers 12 and 14 sequentially onto base 10 and heating the composite to achieve the desired assembly having the proper electrical and mechanical properties.

Typical resins that may be used either simultaneously in both layers 12 and 14 or separately in each layer include those set forth in Jones Pat. No. 3,787,208, namely thermoplastic or thermosetting resins including, but not limited to polysulfones, acrylates, polyethylene, styrene, diallyphthalate, polyphenyl sulfide, melamine formaldehyde, epoxies, polyesters, polyvinyl chloride, nylon, polyvinyl fluoride and mixtures thereof.

The conductive particles 22 in layer 12 may be silver, gold, platinum, copper or brass, as well as other high mass conductive particles that have energy level bands that enable charge carriers to freely move between the semiconductive photoconductive material 20 in layer 14, and the conductor particles 18 in layer 12 under conditions encountered during the xerographic imaging process in which the composite photoreceptor system illustrated is utilized.

The size of conductor particles 22 is generally in the same order as the size of photoconductive particles 20, generally 1 micron or smaller. The idea, of course, is to cause as many particle to particle contacts as possible between photoconductive particles and conductive particles along the interface area between layers 12 and 14, so the order of particle sizes shoulde be similar. In actuality, it is the particles at the chain ends of the photoconductive continuous paths in layer 14 that come into contact with the conductive particles in layer 12 at the interface between the layers when the layer 14 is formed by using the controlled geometry concept described above.

The photoconductor particles in layer 14 may be any of those recited in Jones Pat. No. 3,787,208, or Middleton Pat. No. 3,121,006. Typical materials, for example, include vitreous or amorphous selenium, alloys of selenium, with materials such as arsenic, tellurium, thallium, bisnuth, sulfur, antimony, and mixtures thereof. The above patents may be referred to for a more complete listing of photoconductor materials.

The base layer 10, or course, may be a solid conductor material, a foil, metallized plastic foil, or other laminate or conductive body form known in the xerographic arts.

EXAMPLE I

The following is an example of an embodiment of the invention. An intermediate coating is prepared using a polyurethane and solvent resin having uniformly dispersed therein finely ground silver particles ranging in size between 1 and 5 microns. The silver particles comprise about 50% by volume of the resin, solvent and particle mixture so that a substantial portion of the coating is made up of the silver particles. The resin and silver particle mixture is applied to an aluminum metal substrate base layer and the solvent is evaporated off to leave a thin, adherent coating about 5 microns thick on the aluminum surface. A photoconductor layer is next prepared using 81 parts by volume of a resin comprising a copolymer of 70% isobutyl methacrylate and 30% styrene which has been ground and classified to a mean particle size of 5 microns and having a distribution of from 1 to 8 microns and dispersed in a carrier liquid (silicone fluid 2CS, available from Dow Corning) with 9 parts of a synthesized cadmium sulfoselenide $CdS_{.6}Se_{.4}$ having a particle size ranging from 0.001 to 0.4 microns. A film of this dispersion is cast on the intermediate layer and the carrier liquid evaporated by heating for 2 hours at 50° C. The three layers are then heated for 3 minutes at 175° C during which heating the photoconductive layer fuses into a film 55 microns thick and becomes firmly adhered to the intermediate layer. A dielectric layer of mylar 25 microns thick is finally applied to the surface of the photoconductive layer by adhesive bonding. When a positive charge is applied in the dark to the surface of the dielectric overcoated photoconductor it is found that all the field potential is across the dielectric, and none of the field is preserved across the photoconductor layer, indicating that a charge injecting contact exists between the photoconductor and the intermediate and base layers.

EXAMPLE II

A photoconductive layer prepared in accordance with Example I is applied directly to an aluminum metal substrate without an intermediate layer. The carrier liquid is evaporated off by heating to 50° C for 2 hours and the coating heated at 175° C for 3 minutes to fuse the same in the same manner as recited in Example I. A mylar dielectric layer 25 microns thick is applied to the photoconductor surface as in Example I. When a positive charge is applied in the dark to the surface of the dielectric overcoated photoconductor, it is found that the charge is retained across both the dielectric and photoconductor layers, indicating that a charge carrier blocking contact exists between the photoconductor layer and the intermediate and base layers.

The above examples demonstrate that the intermediate layer of the present invention may be used to insure that a charge injecting contact is obtained between a controlled geometry type photoconductor layer and a charge carrier sink layer. In the prior art device, not using the intermediate layer produced a charge carrier blocking junction between the photoconductor and base layers using the same materials. The use of the intermediate layer also produced an adequate bond between photoconductor and base layers.

I claim:

1. A photosensitive member comprising a conductive substrate, an intermediate layer overlying said substrate and a photoconductive layer overlying said intermediate layer, said photoconductive layer comprising an insulating organic resin matrix containing therein photoconductive particles from 0.01 to 1.0 microns in size, with substantially all of the photoconductive particles being in substantial particle-to-particle contact in said member in a multiplicity of interlocking photoconductive paths through the thickness of said layer, said photoconductive paths being present in a volume concentration, based on the volume of said layer, of from about 1 to 25 percent, with the outer surface of said photoconductive layer comprising organic resin material, said intermediate layer comprising an insulating organic resin matrix bonded to both said photoconductive layer and said substrate, said intermediate layer further comprising, based on the volume of said intermediate layer, from 25 to 99 percent conductive particles selected from the group consisting of silver, gold, platinum, copper and brass ranging in size from 0.1 to 5.0 microns dispersed uniformly in said intermediate layer, said intermediate layer being joined to said photoconductive layer along an interface wherein at least a portion of said photoconductive particles in said photoconductive layer contact at least a portion of said conductive particles in said intermediate layer, said conductive particles having available charge carriers at suitable energy levels whereby said photoconductive particle to conductive particle contact points constitute individual charge carrier injecting contact points.

2. The photosensitive member according to claim 1 wherein the conductive particles are silver and present in a volume loading of 44 percent to 80 percent.

3. The photosensitive member recited in claim 1 wherein said intermediate layer as a whole is a conductive layer between said photoconductive layer and said base layer.

4. The photosensitive member recited in claim 1 wherein the number of photoconductive particle to conductive particle contacts along said interface is sufficient to enable said conductive particles in said intermediate layer as a whole to function as a charge carrier sink for said photoconductive layer as a whole.

5. The photosensitive member recited in claim 1 wherein said photoconductive particles are cadmium sulfoselenide and said conductive particles are silver.

* * * * *